US006240898B1

(12) United States Patent
Meistrick et al.

(10) Patent No.: US 6,240,898 B1
(45) Date of Patent: Jun. 5, 2001

(54) SLAVE PISTON ASSEMBLY WITH VALVE MOTION MODIFIER

(75) Inventors: Zdenek Meistrick, Bloomfield; Vincent Pitzi, South Windsor, both of CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 09/172,917

(22) Filed: Oct. 15, 1998

Related U.S. Application Data

(60) Provisional application No. 60/061,863, filed on Oct. 15, 1997.

(51) Int. Cl.[7] ..... F02D 13/04
(52) U.S. Cl. ..... 123/321
(58) Field of Search ..... 123/320, 321, 123/568.21

(56) References Cited

U.S. PATENT DOCUMENTS

| | | | | |
|---|---|---|---|---|
| 4,572,114 | | 2/1986 | Sickler . | |
| 4,592,319 | | 6/1986 | Meistrick . | |
| 4,936,273 | | 6/1990 | Myers . | |
| 5,000,145 | | 3/1991 | Quenneville . | |
| 5,161,501 | | 11/1992 | Hu . | |
| 5,357,926 | | 10/1994 | Hu . | |
| 5,406,918 | * | 4/1995 | Joko et al. | 123/321 |
| 5,460,131 | | 10/1995 | Usko . | |
| 5,462,025 | | 10/1995 | Israel et al. . | |
| 5,485,819 | * | 1/1996 | Joko et al. | 123/321 |
| 5,619,963 | * | 4/1997 | Faletti et al. | 123/321 |
| 5,645,031 | | 7/1997 | Meneely . | |
| 5,787,859 | | 8/1998 | Meistrick et al. . | |
| 5,794,589 | | 8/1998 | Hakansson . | |
| 5,809,964 | | 9/1998 | Meistrick et al. . | |
| 5,813,321 | * | 9/1998 | Faletti et al. | 123/321 |
| 5,829,397 | * | 11/1998 | Vorih et al. | 123/321 |
| 6,012,424 | * | 1/2000 | Meistrick | 123/321 |

* cited by examiner

*Primary Examiner*—Erick Solis
(74) *Attorney, Agent, or Firm*—David R. Yohannan; Collier Shannon Scott PLLC

(57) ABSTRACT

A valve actuating assembly for actuating at least one valve is disclosed. The valve actuating assembly includes a housing assembly, an actuating assembly for actuating at least one valve during a first valve operating event and a second valve operating event, and an assembly for modifying valve motion travel of the at least one valve during at least one of the first valve operating event and the second valve operating event. A system for providing exhaust gas recirculation and compression release braking in an engine is also disclosed.

41 Claims, 6 Drawing Sheets

SLAVE PISTON ASSEMBLY WITH VALVE MOTION MODIFIER

CROSS REFERENCE TO RELATED PATENT APPLICATION

This application relates to and claims priority on provisional application serial number 60/061,863, filed Oct. 15, 1997.

FIELD OF THE INVENTION

The present invention relates generally to the field of engine control and actuation systems for engine braking systems and on positive power, for internal combustion engines. Specifically, the invention relates to a method and apparatus for modifying exhaust valve motion travel in connection with fixed timing exhaust gas recirculation derived from the intake cam profile. In particular the valve motion travel is modified by limiting inner slave piston travel to a predetermined distance. This permits the advance of the closure of the valve during exhaust gas recirculation. This is accomplished by uncovering a vent hole in an outer slave piston to release fluid to drain thus limiting further travel of the inner slave piston and allowing the inner piston to return to the valve closed position.

OBJECTS OF THE INVENTION

It is an object of the present invention to provide a system for providing exhaust gas recirculation and compression release braking in an engine.

It is another object of the present invention to provide a system for providing exhaust gas recirculation and compression release braking in an engine that includes a valve actuation assembly for actuating the at least one exhaust valve that is capable of actuating the at least one exhaust valve in response to energy from the compression release retarding assembly to perform a compression release retarding operation and is also capable of actuating the at least one exhaust valve in response to energy from the exhaust gas recirculation assembly to perform an exhaust gas recirculation operation.

It is another object of the present invention to an assembly for modifying exhaust valve motion travel of at least one exhaust valve during a exhaust gas recirculation event.

It is another object of the present invention to an assembly for modifying exhaust valve motion travel of at least one exhaust valve during a fixed timing exhaust gas recirculation event. It is another object of the invention to provide a slave piston assembly that is capable of modifying the opening of at least one cylinder valve.

It is also an object of the present invention to provide a slave piston assembly that is capable of modifying the fixed timing opening of at least one cylinder valve.

It is also an object of the invention to provide exhaust valve EGR timing generated by the intake cam.

SUMMARY OF THE INVENTION

The present invention is directed to a system for providing exhaust gas recirculation and compression release braking in an engine. The system includes a compression release retarding assembly for supplying energy to actuate at least one exhaust valve assembly to perform a compression release retarding operation. The system also includes an exhaust gas recirculation assembly for supplying energy to actuate the at least one exhaust valve assembly to perform an exhaust gas recirculation operation. The system also includes a valve actuation assembly for actuating at least one exhaust valve. The valve actuating assembly is capable of actuating the at least one exhaust valve in response to energy from the compression release retarding assembly to perform a compression release retarding operation. The valve actuating assembly is also capable of actuating the at least one exhaust valve in response to energy from the exhaust gas recirculation assembly to perform an exhaust gas recirculation operation.

The valve actuating assembly may include an assembly for modifying exhaust valve motion travel of the at least one exhaust valve during the exhaust gas recirculation event. The exhaust gas recirculation event may be a fixed timing exhaust gas recirculation event.

The valve actuating assembly may include a housing assembly. The valve actuating assembly may also include a first piston assembly movably mounted within the housing assembly for operating the at least one exhaust valve assembly in response to the exhaust gas recirculation assembly to perform the exhaust gas recirculation event. The valve actuating assembly may further include a second piston assembly movably mounted within the housing assembly and operable with the first piston assembly for operating the at least one exhaust valve assembly in response to the compression release retarding assembly to perform the compression release retarding event. The first piston assembly may be slidably received within the second piston assembly.

The valve actuating assembly may also include an assembly for modifying the exhaust valve motion travel of the at least one exhaust valve during the exhaust gas recirculation event. The assembly for modifying the exhaust valve motion travel limits travel of the first piston assembly during the exhaust gas recirculation event. The exhaust gas recirculation event may be a fixed timing exhaust gas recirculation event.

The valve actuating assembly may further include an assembly for modifying exhaust valve motion travel of the at least one exhaust valve during the exhaust gas recirculation event. The assembly for modifying exhaust valve motion travel may include a movable assembly slidably received within the housing assembly. The movable assembly may be slidably received within the first piston assembly. The movable assembly may cooperate with the second piston assembly to modify the exhaust valve motion travel of the at least one exhaust valve during the exhaust gas recirculation event. The exhaust gas recirculation event may be a fixed timing exhaust gas recirculation event. The movable assembly limits travel of the first piston assembly during the exhaust gas recirculation event.

The present invention is also directed to a valve actuating assembly for actuating at least one valve. The valve actuating assembly may include a housing assembly. The valve actuating assembly may further include an actuating assembly for actuating at least one valve during a first valve operating event and a second valve operating event. The valve actuating assembly may further include an assembly for modifying valve motion travel of the at least one valve during at least one of the first valve operating event and the second valve operating event. The first valve operating event may be an exhaust gas recirculation event. The exhaust gas recirculation event may be a fixed timing exhaust gas recirculation event.

The actuating assembly may include a first or inner piston assembly movably mounted within the housing assembly for operating the at least one valve assembly during the first valve operating event. The actuating assembly may further include a second piston assembly movably mounted within the housing assembly and operable with the first or outer piston assembly for operating the at least one valve assembly during the second valve operating event. The assembly for modifying exhaust valve motion travel limits travel of the first piston assembly during the first valve operating event. The first piston assembly may be slidably received within the second piston assembly.

The assembly for modifying valve motion travel may include a movable assembly slidably received within the housing assembly. The movable assembly may be slidably received within the first piston assembly. The movable assembly preferably cooperates with the second piston assembly to modify the valve motion travel of the at least one valve during at least one of the first valve operating event and the second valve operating event. The movable assembly cooperates with the second piston assembly to modify the valve motion travel of the at least one valve during the first valve operating event, where the first valve operating event is an exhaust gas recirculation event.

The present invention is also directed to a valve actuating assembly or slave piston assembly for actuating at least one valve. The valve actuating assembly may include a housing assembly. The valve actuating assembly may further include an actuating assembly for actuating at least one valve during a first valve operating event and a second valve operating event. The valve actuating assembly may further include an assembly for modifying valve motion travel of the at least one valve during at least one of the first valve operating event and the second valve operating event.

The actuating assembly may include a first valve actuating assembly movably mounted within the housing assembly for operating at least one valve assembly during the first valve operating event. The actuating assembly may further include a second valve actuating assembly movably mounted within the housing assembly and operable with the first valve actuating assembly for operating the at least one valve assembly during the second valve operating event.

The assembly for modifying exhaust valve motion travel limits travel of the first valve actuating assembly during the first valve operating event. The assembly for modifying valve motion travel includes a movable assembly slidably received within the housing assembly. The movable assembly cooperates with the second slave piston assembly to modify the valve motion travel of the at least one valve during at least one of the first valve operating event and the second valve operating event. The movable assembly preferably cooperates with the second slave piston assembly to modify the valve motion travel of the at least one valve during the first valve operating event.

BRIEF DESCRIPTION OF THE DRAWINGS

The invention will be described in conjunction with the following drawings in which like reference numerals designate like elements and wherein.

DETAILED DESCRIPTION OF THE PREFERRED EMBODIMENTS

Figure 1:
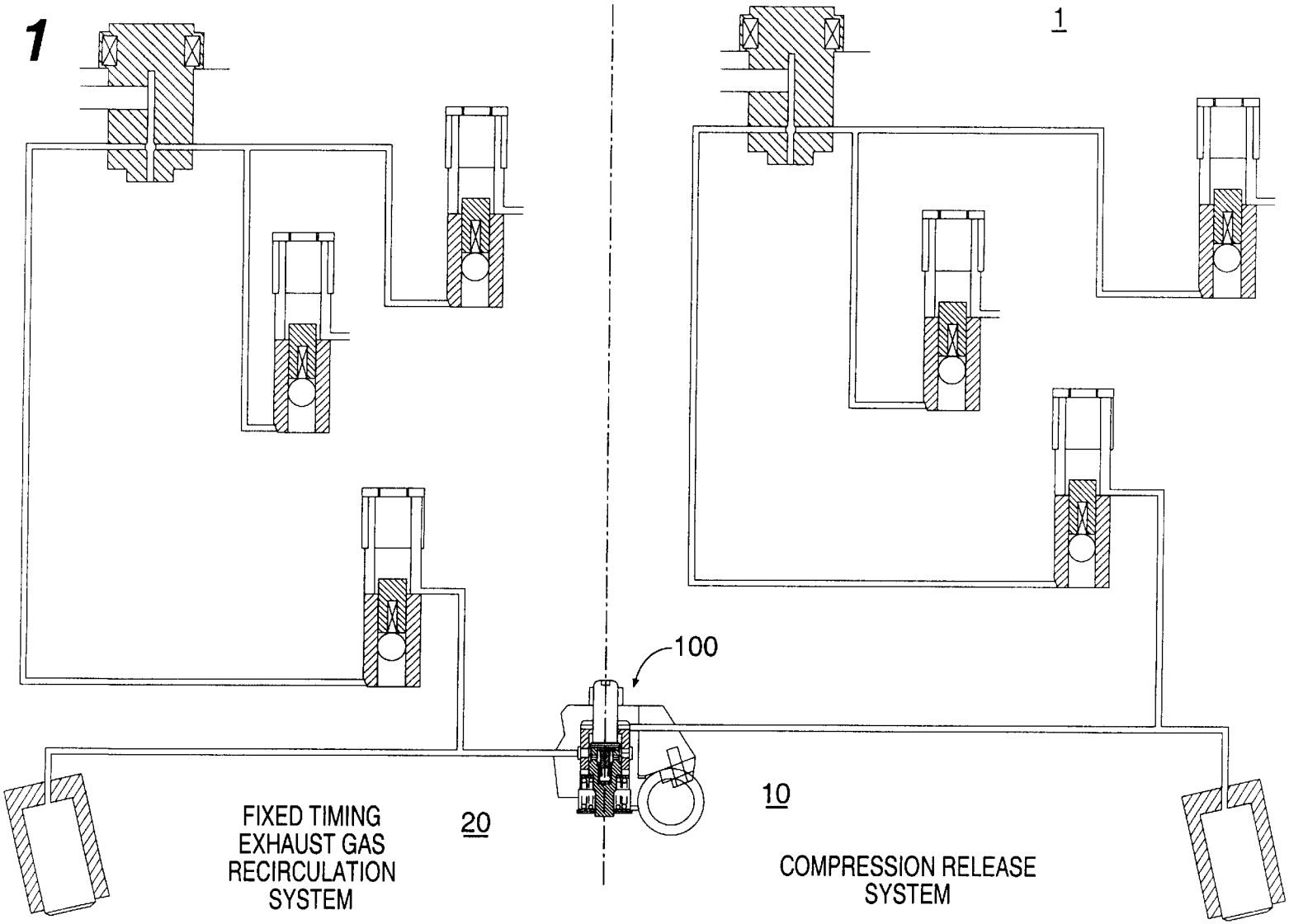
FIG. 1 depicts a combined system for fixed timing exhaust gas recirculation and compression release retarding having a valve actuation system in accordance with an embodiment of the present invention shown for use in a six cylinder in line engine, for example.
Figure 2:
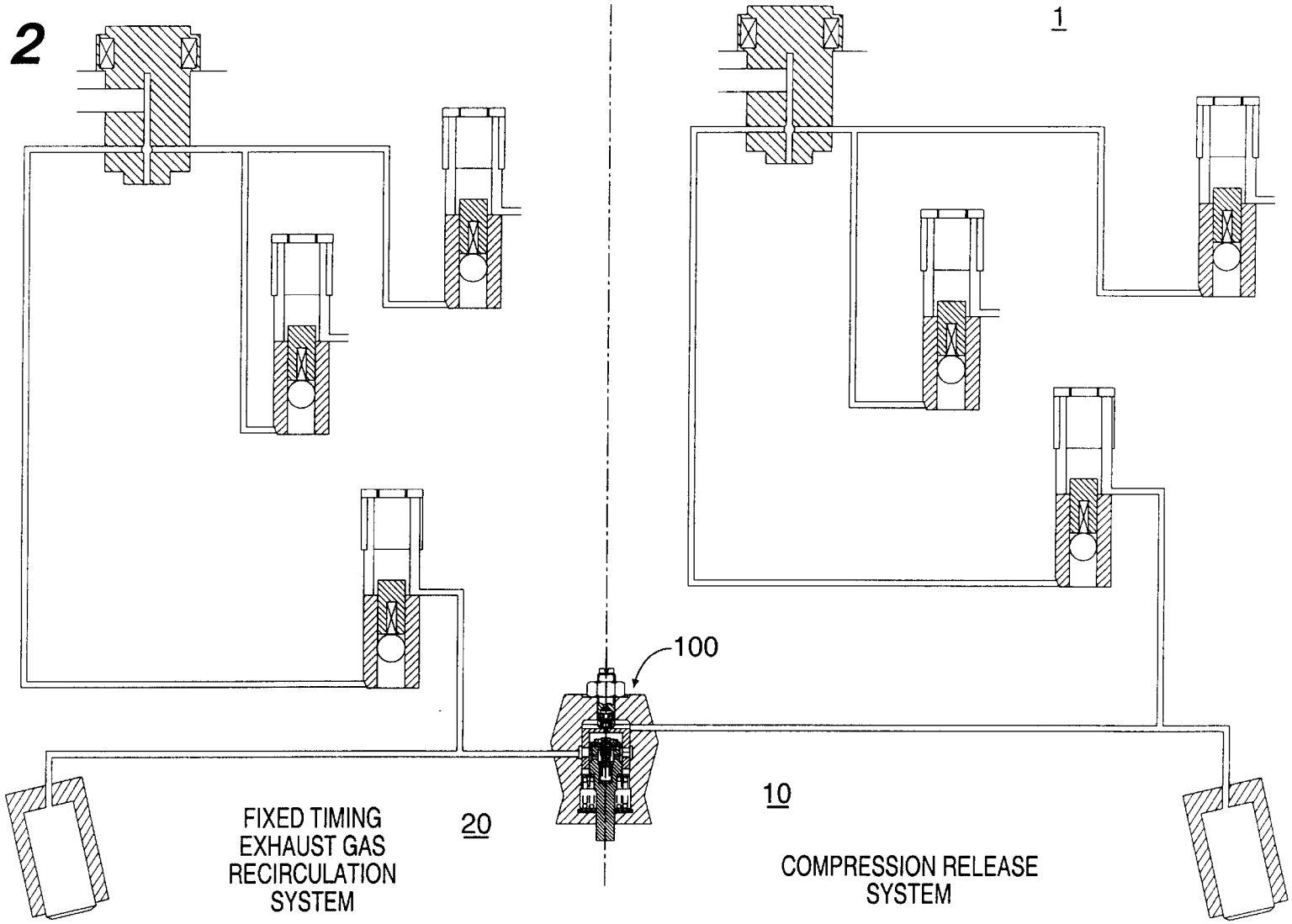
FIG. 2 depicts a combined system for fixed timing exhaust gas recirculation and compression release retarding having a valve actuation system in accordance with another embodiment of the present invention shown for use in a six cylinder in line engine, for example.

The present invention is directed to a system 1 for providing exhaust gas recirculation and compression release braking in an engine. As shown in FIGS. 1 and 2, the system 1 includes a compression release retarding system 10 and an exhaust gas recirculation assembly 20. The exhaust gas recirculation assembly 20 is preferably a fixed timing exhaust gas recirculation assembly for carrying out a fixed timing exhaust gas recirculation event. In a preferred embodiment of the present invention, the energy to perform the fixed timing exhaust gas recirculation event is derived from an intake cam profile. The present invention, however, is not limited to fixed timing exhaust gas recirculation; rather, it is contemplated that the variable timing exhaust gas recirculation is considered to be within the scope of the present invention. Furthermore, the present invention is not limited to energy derived from the intake cam profile; rather, it is contemplated that energy to perform the exhaust gas recirculation event can be derived from another source including but not limited to an exhaust cam profile.

The system 1 also includes a valve motion modifier actuating assembly 100 for opening at least one cylinder valve. The valve motion modifier actuating assembly 100 is preferably a slave piston assembly. The unique valve actuating assembly 100 permits modification of the valve motion travel under certain engine conditions (i.e., exhaust gas recirculation).

Figure 3:
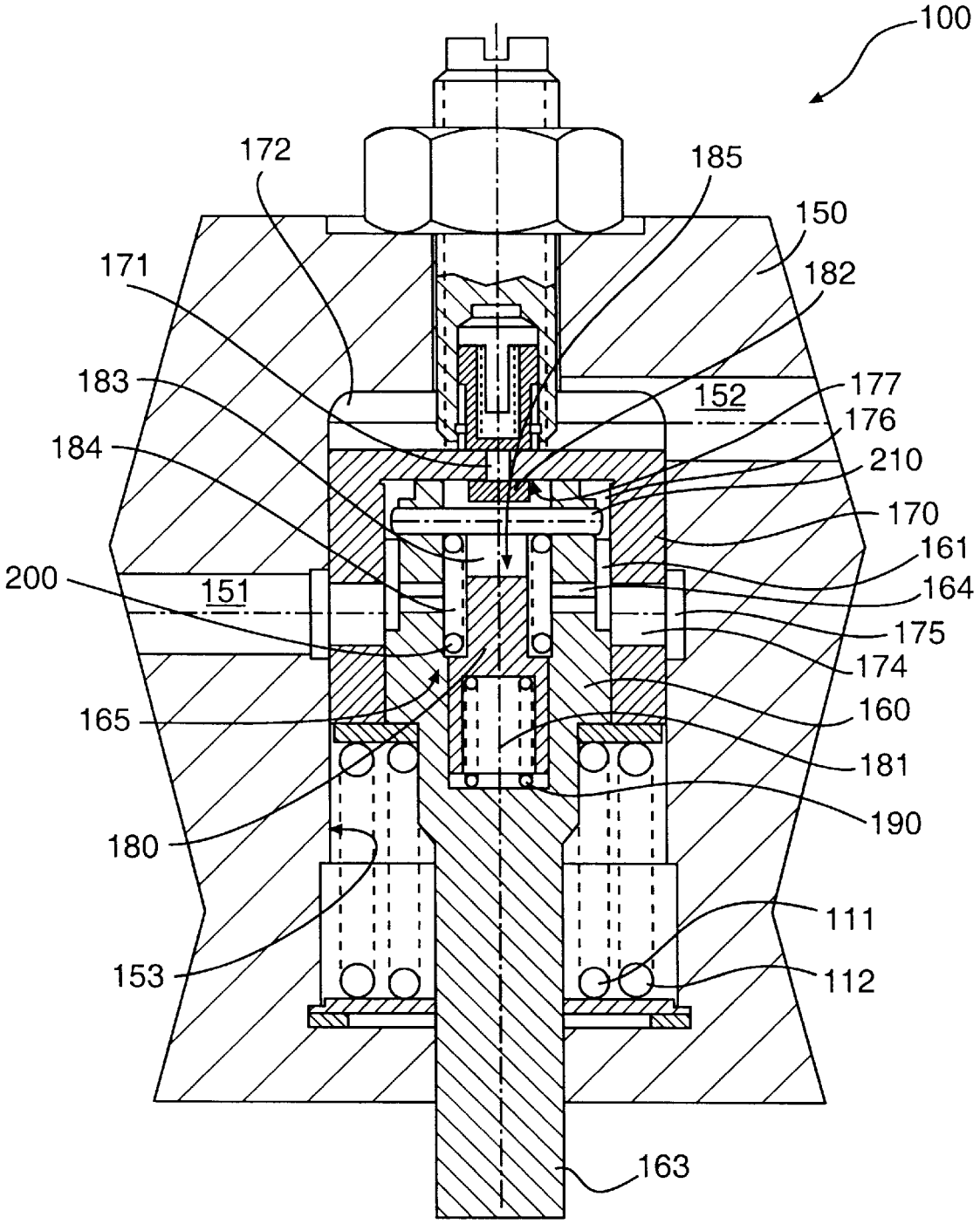
FIG. 3 depicts a valve actuation assembly according to the present invention in the "OFF" position.

The valve actuating assembly 100 of the present invention includes a valve actuating housing 150, an inner slave piston 160, an outer slave piston 170, and a clip plunger 180. FIG. 3 depicts the valve actuating assembly 100 in the "OFF" position, that is when the valve actuating assembly 100 is not actuated by either an exhaust gas recirculation assembly 20 through channel 151 or a compression release retarding assembly 10 through channel 152. In the "OFF" position, the inner slave piston 160 and the outer slave piston 170 is biased assembly upward into bore 153 in the valve actuating housing 150. The biasing assembly may include at least one spring 111 or 112 Seat spring 190 biases the top surface 182 of the plunger clip 180 against the undersurface 177 of outer slave piston 170, covering an aperture 171 formed in the outer slave piston 170.

The inner slave piston 160 includes a plurality of slots 161 that longitudinally extend along a portion of the upper circumference of the inner slave piston 160, as shown in FIG. 3. The slots 161 permit hydraulic fluid to flow from channel 151 through the outer slave piston 170 to a cavity 176 formed in the interior of the outer slave piston 170. The inner slave piston 160 is slidably mounted within the cavity 176. During exhaust gas recirculation, hydraulic fluid flows from the exhaust gas recirculation assembly 20 through the channel 151 through an annular groove 175 and apertures 174 within the outer slave piston 170 through slots 161 into the cavity 176. This causes the inner slave piston 160 to move in a downwardly direction within cavity 176. A stem 163 on the inner slave piston 160 engages an appropriate assembly to open at least one cylinder valve to effectuate exhaust gas recirculation.

The inner slave piston 160 includes an inner cavity 183. The plunger clip 180, the seat spring 190 and a reset spring 200 are located within the inner cavity 183. The seat spring 190 is located within a lower cavity 181 formed in the plunger clip 180, as shown in FIG. 3. The seat spring 190 biases the plunger clip 180 in an upward direction within the inner cavity 183 such that the top portion 182 of the plunger clip 180 occludes aperture 171 in the outer slave piston 170. A clip pin 210 extends through the upper portion of the inner slave piston 160 and upper cavity 183 in the plunger clip 180. One end of the reset spring 200 engages the clip pin 210. The other end of the reset spring 200 alternatively engages a ledge 165 in the inner cavity 183 and ledge 184 formed on the plunger clip 180, as shown in FIG. 3.

At the beginning of a compression release retarding stroke, high pressure hydraulic fluid is supplied through channel 152 to the upper end 172 of the cavity 153 in slave piston housing 150. The high pressure hydraulic fluid forces outer slave piston 170 and inner slave piston 160 to move in a downward direction through cavity 153. During the course of its downward travel, the plunger clip 180 travels with outer slave piston 170, occluding aperture 171.

In a preferred embodiment of the present invention, inner slave piston 160 includes means to modify the motion of the inner slave piston 160 for the purpose of modifying the travel of at least one valve. The travel of the at least one valve is modified during the exhaust gas recirculation event. As embodied herein, high pressure hydraulic fluid is supplied from the exhaust gas recirculation assembly 20 to channel 151. Slave piston housing 150 has an annular groove 175 formed along the inner wall thereof in communication with apertures 174. High pressure, hydraulic fluid admitted by channel 151 communicates with the annular groove 175 and apertures 174 to impinge inner slave piston 160. During the exhaust gas recirculation stroke, outer slave piston 170 is disposed in the top portion of cavity 153. Only low pressured hydraulic fluid is supplied to cavity 153 through channel 152, allowing outer slave piston 170 to stay in place in the upper portion of cavity 153.

Figure 4:
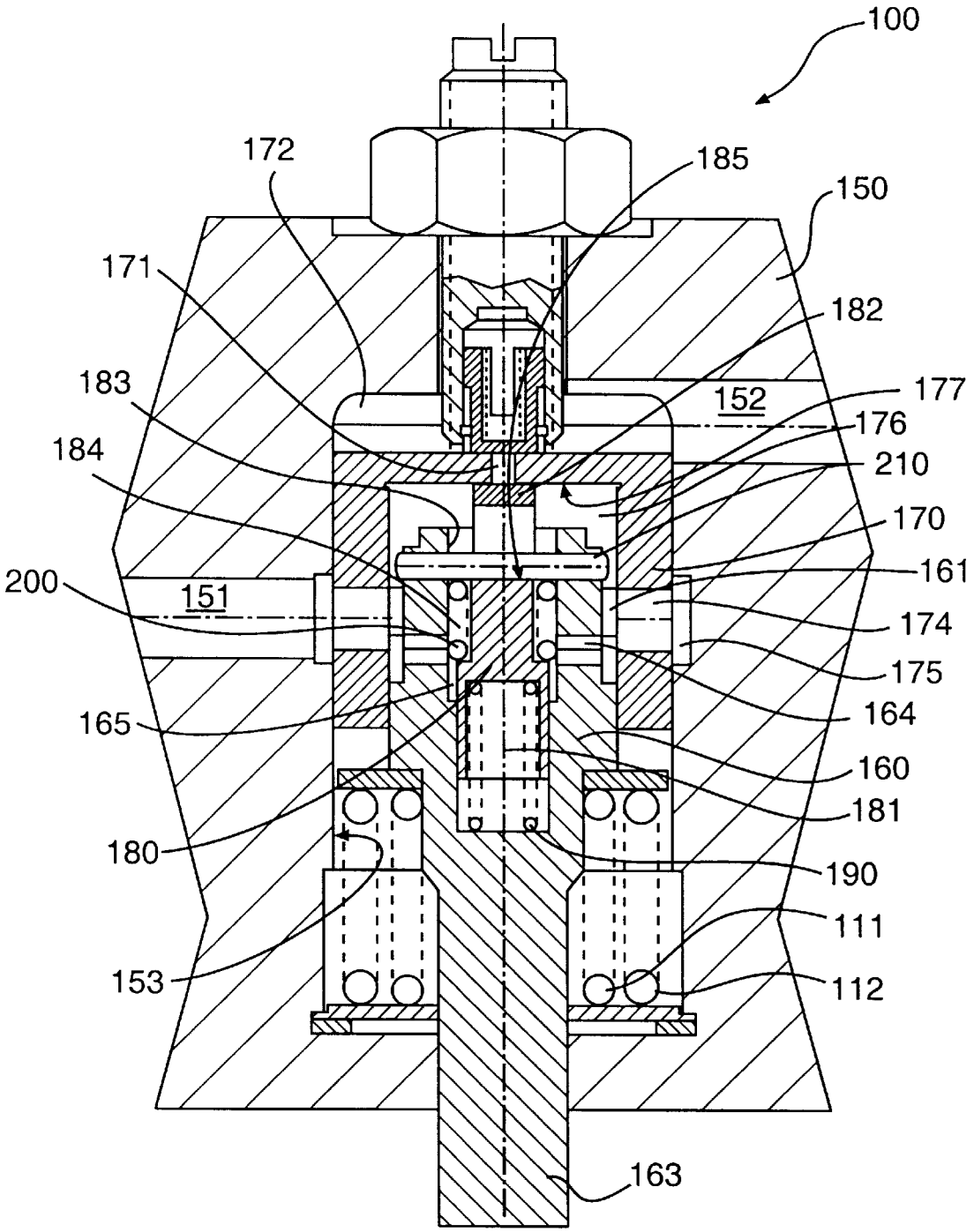
FIG. 4 depicts the valve actuation assembly of FIG. 3 with the plunger clip in a closed fully extended position.

With reference to FIG. 4, as high pressure, hydraulic fluid is delivered to inner slave piston 160 through channel 151, annular groove 175 and apertures 174, inner slave piston 160 moves downward within outer slave piston 170. As high pressure hydraulic fluid is admitted to the interior of inner slave piston 160, it expands the space between the upper portion of inner slave piston 160 and the underside of outer slave piston 170. As the inner slave piston 160 slides downward within outer slave piston 170, pressure differential between cavity 176 and cavity over surface 172 keep plunger clip 180 in sealing contact with surface 177 of the outer piston 170, as shown in FIG. 4. As the inner slave piston 160 travels downwardly within the outer slave piston 170, the clip pin 210 contacts surface 185 of the plunger clip 180.

Figure 5:
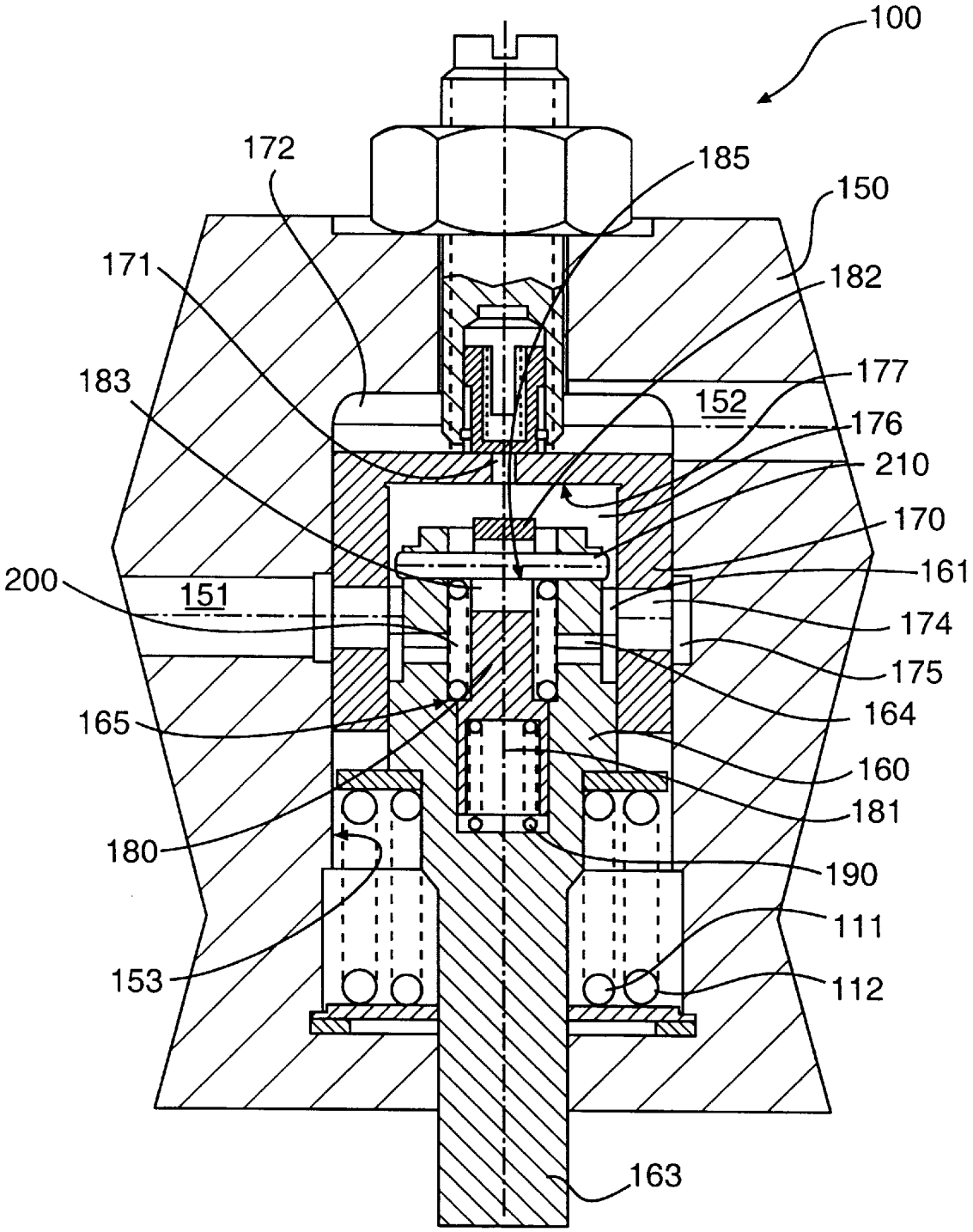
FIG. 5 depicts the valve actuation assembly of FIG. 3 with the plunger clip in an open position.
Figure 6:
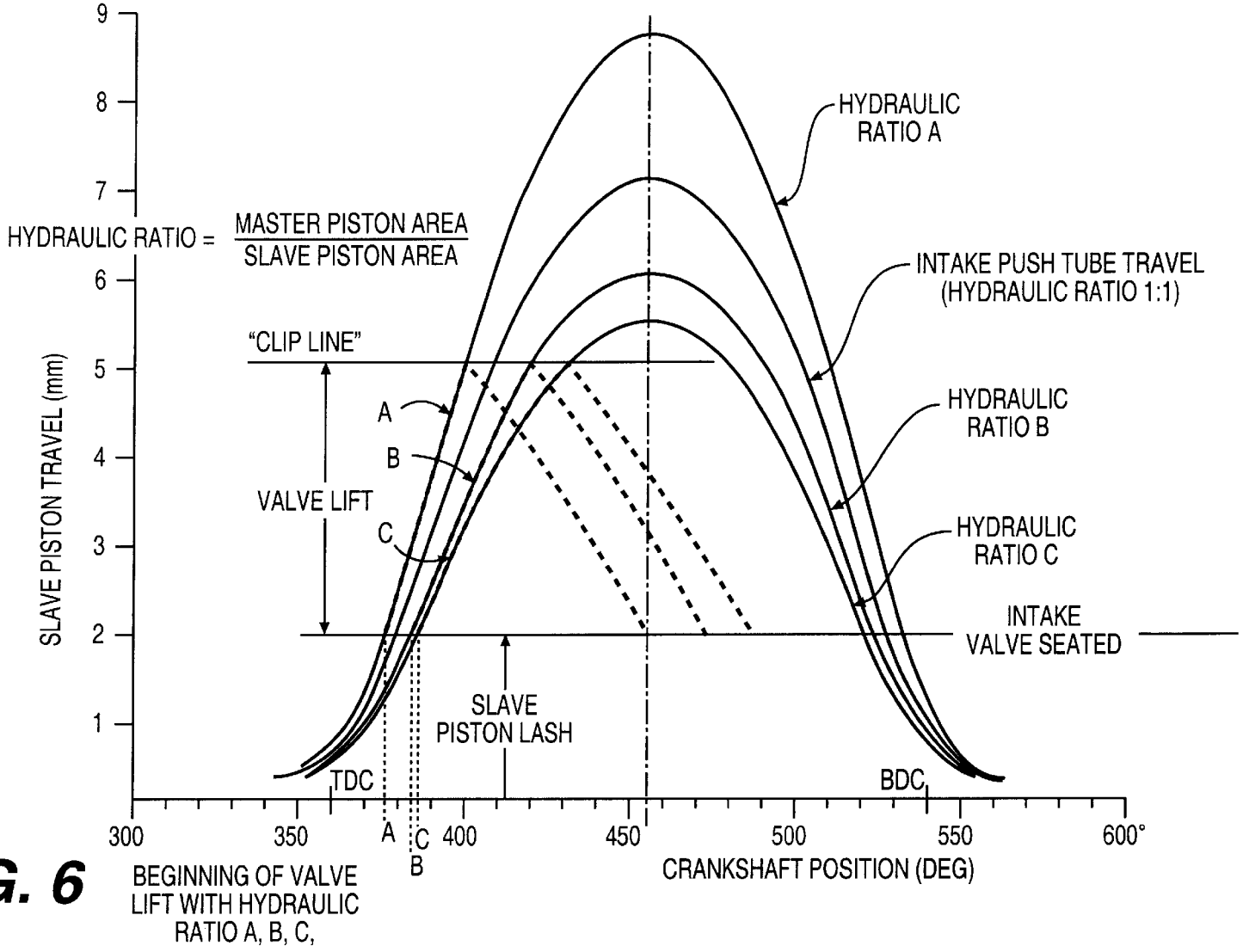
FIG. 6 is a graph depicting the modification of the valve opening using the valve actuating assembly according to the present invention.

With reference to FIG. 5, contact of surface 185 with clip pin 210 causes the top portion 182 to be pulled away from aperture 171 in the outer slave piston 170. Hydraulic fluid can then escape through aperture 171. At this time, the reset spring 200 resets the plunger clip 180 to return to the position shown in FIG. 3.

The drainage of the hydraulic fluid through the aperture 171 permits the inner slave piston 160 to return to the position shown in FIG. 2, whereby the at least one valve is closed. This closure of the valve completes the exhaust gas recirculation event until the valve is again opened by fluid from channel 151 causing the inner slave piston 160 to move in a downward direction. The dotted lines in FIG. 7 illustrate the modified valve opening using the valve actuating assembly 100 of the present invention. The modified opening of the valve effectuates efficient exhaust gas recirculation.

While this invention has been described in conjunction with specific embodiments thereof, it is evident that many alternatives, modifications and variations will be apparent to skilled in the art. Accordingly, the preferred embodiments of the invention as set forth herein are intended to be illustrative, not limiting. Various changes may be made without departing from the spirit and scope of the invention as defined in the following claims.

What is claimed is:

1. A system for providing exhaust gas recirculation and compression release braking in an engine, said system comprising:

a compression release retarding assembly for supplying energy to actuate at least one exhaust valve assembly to perform a compression release retarding operation;

an exhaust gas recirculation assembly for supplying energy to actuate said at least one exhaust valve assembly to perform an exhaust gas recirculation operation;

valve actuation means for actuating said at least one exhaust valve, wherein said valve actuating means is capable of actuating said at least one exhaust valve in response to energy from said compression release retarding assembly to perform a compression release retarding operation, said valve actuating means is capable of actuating said at least one exhaust valve in response to energy from said exhaust gas recirculation assembly to perform an exhaust gas recirculation operation; and means for independently transferring energy from said compression release retarding assembly and said exhaust gas recirculation assembly to said valve actuation assembly.

2. The system according to claim 1, wherein said valve actuating means includes means for modifying exhaust valve motion travel of said at least one exhaust valve during the exhaust gas recirculation event.

3. The system according to claim 2, wherein the exhaust gas recirculation event is a fixed timing exhaust gas recirculation event.

4. The system according to claim 1, wherein said valve actuating means comprises:

a housing assembly;

a first piston assembly movably mounted within said housing assembly for operating said at least one exhaust valve assembly in response to said exhaust gas recirculation assembly to perform the exhaust gas recirculation event; and a second piston assembly movably mounted within said housing assembly and operable with said first piston assembly for operating said at least one exhaust valve assembly in response to said compression release retarding assembly to perform the compression release retarding event.

5. The system according to claim 4, wherein said valve actuating means includes means for modifying exhaust valve motion travel of said at least one exhaust valve during the exhaust gas recirculation event.

6. The system according to claim 5, wherein the exhaust gas recirculation event is a fixed timing exhaust gas recirculation event.

7. The system according to claim 5, wherein said means for modifying exhaust valve motion travel limits travel of said first piston assembly during the exhaust gas recirculation event.

8. The system according to claim 7, wherein the exhaust gas recirculation event is a fixed timing exhaust gas recirculation event.

9. The system according to claim 4, wherein said first piston assembly is slidably received within said second piston assembly.

10. The system according to claim 9, wherein said valve actuating means includes means for modifying exhaust valve motion travel of said at least one exhaust valve during the exhaust gas recirculation event.

11. The system according to claim 10, wherein said means for modifying exhaust valve motion travel includes a movable assembly slidably received within said housing assembly.

12. The system according to claim 11, wherein said movable assembly is slidably received within said first piston assembly.

13. The system according to claim 12, wherein said movable assembly cooperates with said second piston assembly to modify the exhaust valve motion travel of said at least one exhaust valve during the exhaust gas recirculation event.

14. The system according to claim 13, wherein the exhaust gas recirculation event is fixed timing exhaust gas recirculation event.

15. The system according to claim 14, wherein said movable assembly limits travel of said first piston assembly during the exhaust gas recirculation event.

16. The system according to claim 4, wherein said valve actuating means further includes means for limiting the travel of said at least one exhaust valve.

17. A valve actuating assembly for actuating at least one valve, said valve actuating assembly comprising:

a housing assembly;

actuating means for actuating at least one valve during a first valve operating event and a second valve operating event;

a compression release hydraulic energy source and an exhaust gas recirculation energy source independently and operatively connected to said actuating means; and means for modifying valve motion travel of said at least one valve during at least one of said first valve operating event and said second valve operating event.

18. The valve actuating assembly according to claim 17, further comprising means for limiting the travel of said at least one valve.

19. The valve actuating assembly according to claim 17, wherein the first valve operating event is an exhaust gas recirculation event.

20. The valve actuating assembly according to claim 19, wherein the exhaust gas recirculation event is a fixed timing exhaust gas recirculation event.

21. The valve actuating assembly according to claim 17, wherein said actuating means comprises:

a first piston assembly movably mounted within said housing assembly for operating said at least one valve assembly during said first valve operating event; and a second piston assembly movably mounted within said housing assembly and operable with said first piston assembly for operating said at least one valve assembly during said second valve operating event.

22. The valve actuating assembly according to claim 21, wherein said means for modifying exhaust valve motion travel limits travel of said first piston assembly during said first valve operating event.

23. The valve actuating assembly according to claim 22, wherein the first valve operating event is an exhaust gas recirculation event.

24. The valve actuating assembly according to claim 23, wherein the exhaust gas recirculation event is a fixed timing exhaust gas recirculation event.

25. The valve actuating assembly according to claim 21, wherein said first piston assembly is slidably received within said second piston assembly.

26. The valve actuating assembly according to claim 25, wherein said means for modifying valve motion travel includes a movable assembly slidably received within said housing assembly.

27. The valve actuating assembly according to claim 26, wherein said movable assembly is slidably received within said first piston assembly.

28. The valve actuating assembly according to claim 27, wherein said movable assembly cooperates with said second piston assembly to modify the valve motion travel of said at least one valve during at least one of said first valve operating event and said second valve operating event.

29. The valve actuating assembly according to claim 28, wherein said movable assembly cooperates with said second piston assembly to modify the valve motion travel of said at least one valve during said first valve operating event.

30. The valve actuating assembly according to claim 29, wherein the first valve operating event is an exhaust gas recirculation event.

31. The valve actuating assembly according to claim 30, wherein the exhaust gas recirculation event is fixed timing exhaust gas recirculation event.

32. A valve actuating assembly for actuating at least one valve, said valve actuating assembly comprising:

a housing assembly;

actuating means for actuating at least one valve during a first valve operating event and a second valve operating event; and means for modifying valve motion travel of said at least one valve during at least one of said first valve operating event and said second valve operating event, wherein said actuating means comprises:

a first slave piston assembly movably mounted within said housing assembly for operating said at least one valve assembly during said first valve operating event; and a second slave piston assembly movably mounted within said housing assembly and operable with said first slave piston assembly for operating said at least one valve assembly during said second valve operating event, and wherein said first slave piston assembly is slidably received within said second slave piston assembly.

33. The valve actuating assembly according to claim 32, further comprising means for limiting the travel of said at least one valve.

34. The valve actuating assembly according to claim 32, wherein the first valve operating event is an exhaust gas recirculation event.

35. The valve actuating assembly according to claim 34, wherein the exhaust gas recirculation event is a fixed timing exhaust gas recirculation event.

36. The valve actuating assembly according to claim 32, wherein said means for modifying exhaust valve motion travel limits travel of said first slave piston assembly during said first valve operating event.

37. The valve actuating assembly according to claim 32, wherein said means for modifying valve motion travel includes a movable assembly slidably received within said housing assembly.

38. The valve actuating assembly according to claim 37, wherein said movable assembly cooperates with said second slave piston assembly to modify the valve motion travel of said at least one valve during at least one of said first valve operating event and said second valve operating event.

39. The valve actuating assembly according to claim 38, wherein said movable assembly cooperates with said second slave piston assembly to modify the valve motion travel of said at least one valve during said first valve operating event.

40. The valve actuating assembly according to claim 39, wherein the first valve operating event is an exhaust gas recirculation event.

41. The valve actuating assembly according to claim 40, wherein the exhaust gas recirculation event is fixed timing exhaust gas recirculation event.

* * * * *